United States Patent [19]

Lester

[11] 4,428,413

[45] Jan. 31, 1984

[54] HIGH ACCURACY INJECTOR FOR DIE CASTING MACHINES AFFORDING AUTOMATIC MELT LEVEL COMPENSATION

[76] Inventor: William M. Lester, 4389 White Cedar La., Delray Beach, Fla. 33445

[21] Appl. No.: 311,928

[22] Filed: Oct. 16, 1981

[51] Int. Cl.[3] ..... B22D 17/04; B22D 17/30

[52] U.S. Cl. ..... 164/155; 164/457; 222/596

[58] Field of Search ..... 164/457, 136, 155, 312, 164/314, 315, 318; 222/596

[56] References Cited

U.S. PATENT DOCUMENTS

| | | | |
|---|---|---|---|
| 3,128,912 | 4/1964 | Cash | 222/596 |
| 3,591,052 | 7/1971 | Nef | 164/312 X |
| 3,951,199 | 4/1976 | Pereira | 164/457 |
| 4,085,791 | 4/1978 | Kaiser | 164/318 |

*Primary Examiner*—Gus T. Hampilos
*Assistant Examiner*—Peter B. Martine
*Attorney, Agent, or Firm*—Laurence R. Brown

[57] ABSTRACT

A melting pot reservoir for non-ferrous metals and the like to be die cast in a cold chamber mold is provided with a pumping mechanism having a displacement plunger for metering out by displacement from the reservoir an exact volume of molten material into the mold. This same plunger is provided with a vernier adjustment and accompanying control circuit that automatically moves the plunger an increment into the molten material after each charge the precise amount to restore the molten material level to a predetermined optimum datum level for delivery of exactly the precise amount of charge into the cold chamber.

5 Claims, 2 Drawing Figures

HIGH ACCURACY INJECTOR FOR DIE CASTING MACHINES AFFORDING AUTOMATIC MELT LEVEL COMPENSATION

TECHNICAL FIELD

This invention relates to die casting machines and more particularly it relates to injectors pumping charges of molten metal from a melting pot reservoir supply into a cold die chamber.

BACKGROUND ART

Die casting machines for ladeling molten material such as non-ferrous metals into a mold are typified by U.S. Pat. Nos. 3,652,073—D. S. Lewis—Mar. 28, 1972 and 3,430,685—H. Drugowitsch—Mar. 4, 1969. These machines have a piston displacement pump plunger that meters out a predetermined charge of molten metal into a cold chamber die.

Because the molten material is displaced by the plunger, the quantity of the charge delivered is very sensitive to the surface level to the molten material. It has therefore not been feasible to use the displacement plunger under conditions where the melting pot level varies. Thus, the charges delivered are not maintained within the close limits required to fill the die without waste over a considerable number of die cycles taken from the melting pot reservoir before refilling or readjusting the level.

An attempt to cure this problem is found in U.S. Pat. No. 3,591,052—A. Nef—July 6, 1971, wherein a large volume reservoir of molten metal feeds a smaller volume pump disposed therein. The level of the reservoir is adjusted when it falls below an index level by insertion of a displacement body to compensate for the molten metal being pumped into the die.

Not only are time delays introduced by this technique, and the necessity to avoid surface ripples or waves, but it also is applicable only when the production speed is slow enough to let the system equalize. Also the degree of control of a large reservoir cannot be as precise as for the control of the smaller quantities in the pumping system and thus the accuracy or precision of a delivered charge can still vary considerably.

Primarily this technique is unacceptable because the amount of level adjustment is dependent upon a level sensor and surface level relationship that can vary differently than the actual change in level caused by removing a charge.

It is therefore an object of this invention to provide improved precise controls of the size of the charge displaced out of a reservoir of molten material into the cold chamber of the die casting machine, by accurately controlling the level of the material in the reservoir as a function of the amount of charge delivered rather than the level of the material in the reservoir.

Also, the Nef compensating system is complex in requiring two separate control systems and two controlled plungers.

It is an object of this invention to provide a simpler and therefore more reliable control means.

Further objects, features and advantages of the invention will be found throughout the following description, drawing and claims.

DISCLOSURE OF THE INVENTION

In accordance with this invention therefore a displacement plunger is inserted into a melting pot to displace a measured quantity of molten material therefrom into the cold chamber of a die casting machine. Then in response to the removal of the charge the displacement plunger is moved further into the melting pot an increment displacing a volume equal to that of the removed charge to readjust the level of the molten material exactly to a starting datum level assuring precise metering of the exact amount of charge to fill the mold without waste.

The control system for operating the level compensation is automatic and versatile and thus can be easily programmed for charges of various sizes as molds are changed, etc.

THE PREFERRED EMBODIMENT

Figure 1:
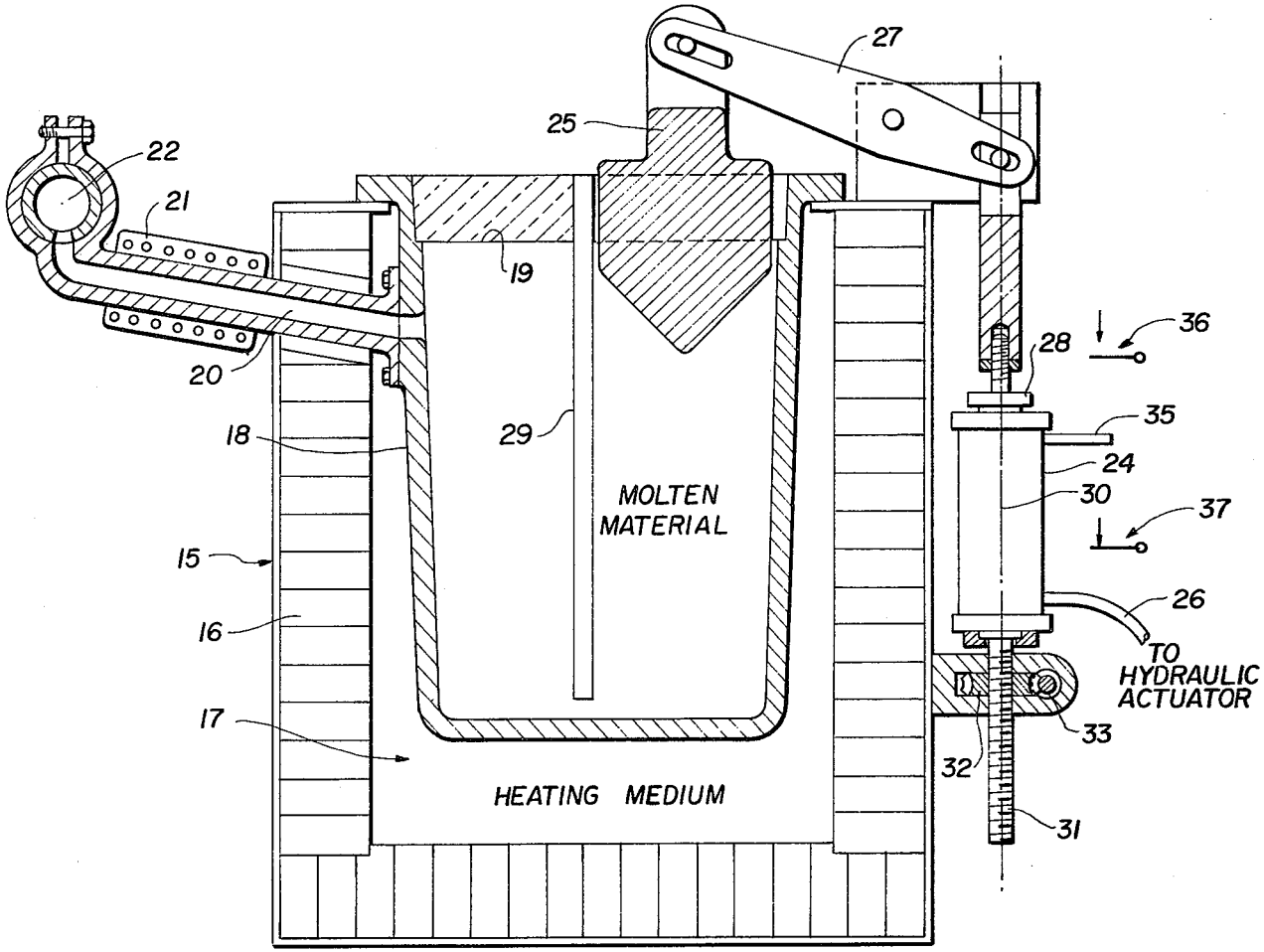
FIG. 1 is an elevation sketch, partly in section view, of a furnace with a charge injector for die casting machines mounted therein as afforded by this invention to automatically compensate for changes in melt level as the charges are withdrawn.

As may be seen from FIG. 1, a furnace 15 has fire brick 16 or the like, surrounding some appropriate heating medium such as gas flame in the compartment 17 for melting a non-ferrous material to be cast, such as aluminum, in the iron crucible 18. Level line 19 is slightly lower than bottom of cold chamber 22 and serves as a visual mark for metal level maintenance and reloading of crucible.

An exit conduit 20, heated by heating element 21 provides for transfer of metered charges of molten material from the crucible 18 melting pot reservoir into the cold chamber 22 of the die casting machine.

The transfer process is that of displacement of molten material from the melting pot 18 by insertion of displacement plunger 25 thereinto. Thus, a precisely measured displacement stroke can be delivered from hydraulic cylinder 24 coupled by hydraulic lines 26 to actuating systems of the general type described in the aforementioned patents, for example.

Thus, by way of rocking lever 27 and downward stroke of plunger 25 the molten material travels from crucible melting pot reservoir 18 through heated channel 20 into cold chamber 22. To precisely measure an exact quantity of prevent waste by underflow and yet exactly fill the cold chamber 22 into the chamber defined by wall 29, the volume displacement of plunger 25 is precisely known as well as the stroke of the piston assembly 28 of the hydraulic cylinder 24.

However, after a charge is delivered from the reservoir 18, the level of molten material for the next charge changes therein. This changed level would cause a variation of the next delivered charge and prevent the desired goal of delivery of an exact charge amount without waste from overflow or defective castings from underflow.

Control of the level is afforded by this invention by vernier control of the displacement plunger 25, thereby avoiding a further level control member and the complications of geometry and cost thereof, etc. In this way the molten level in pot 18 may be kept at exactly the same level prior to each and every displacement by plunger 25, such as level line 19 which is at the lower entrance of the cold chamber 22. It is recognized therefore that an incremental insertion of displacement plunger 25 into the melt after each charge is removed will serve to restore the level exactly to the desired datum level 19 and that therefore much more precise control is afforded over the repetitive metering of a charge exactly proper for the mold in use.

To effect this mode of operation provided by the present invention, the hydraulic cylinder 24 is movably positioned for vertical motion along axis 30, in a track guide arrangement not shown for preventing rotation of the cylinder 24. The vertical incremental adjustment is then made by way of integrally affixed screw 31, with rotatable cylindrical nut 32 having about the outer periphery worm gear mating with worm 33. Thus, by turning worm 33 and rotating nut 32 mating with threaded screw 31 the cylinder 24 may be raised an exact amount to compensate for molten material removed in preceeding shot.

For control purposes, a feeler 35 can actuate limit switches 36, 37 at upper and lower limits of movement of the cylinder 24 by means of the vernier adjusting mechanism 31, 32, 33. In the shown embodiment, upper limit switch 36 will be closed and lower limit switch 37 will be opened as the feeler 35 engages them during movement of cylinder 24. It is to be recognized that control circuit variations may be made without departing from the spirit or scope of this invention.

Figure 2:
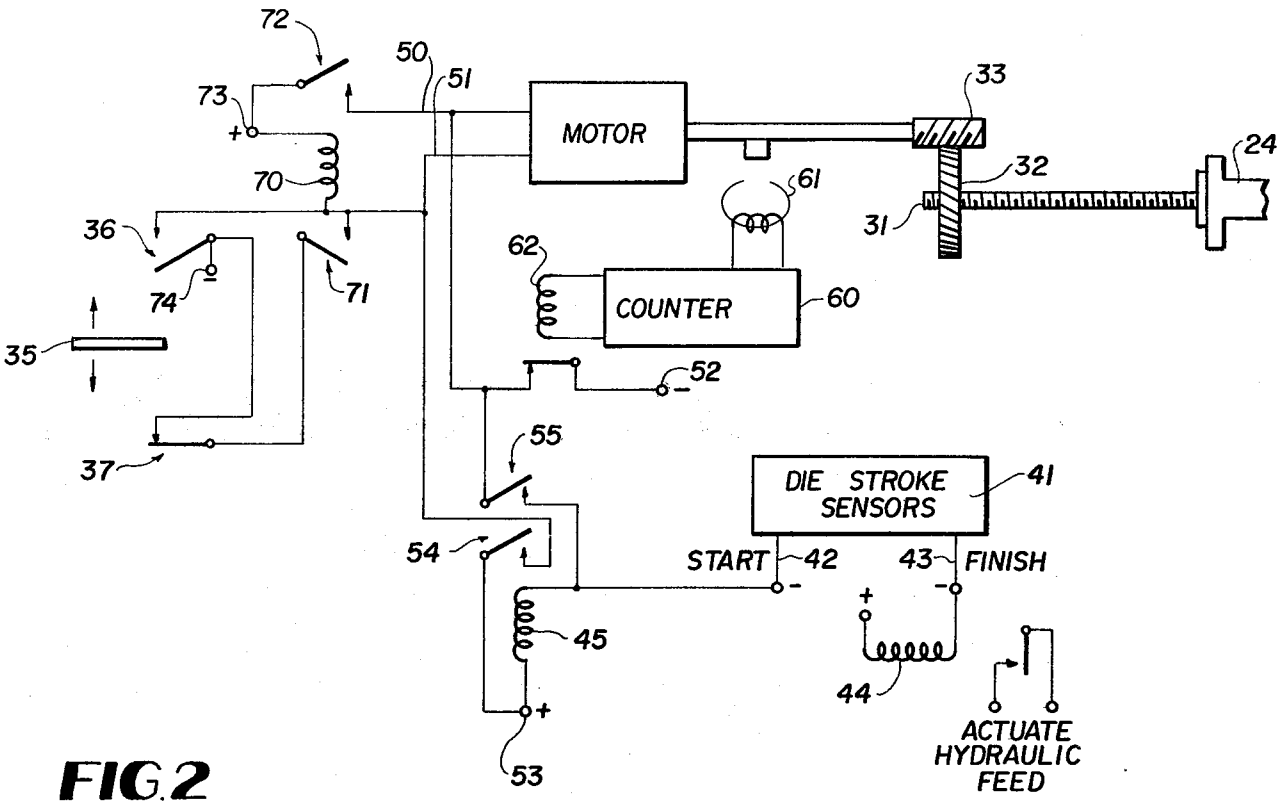
FIG. 2 is a schematic diagram, partly in block form, of a control circuit for providing automatic level compensation control in the injector system of FIG. 1.

The control system is set out schematically in FIG. 2 with like reference characters referring to similar parts for purpose of comparison. A d-c electric motor 40 drives the worm 33 reversibly as the power supply (not shown) polarity (+ or −) is changed by the control circuit. Thus, the position of the hydraulic cylinder 24 may be reset by reversal of the motor when the reservoir pot 18 is emptied and ready for refilling.

Under static conditions with feeler 35 in an intermediate position, as shown, the motor 40 is not connected and the cylinder 24 remains at rest. Appropriate die stroke sensors 41 will provide an impulse signal (referenced to the − power supply potential in this embodiment) at the start 42 and finish 43 terminals for control purposes to actuate a new hydraulic injection cycle via relay 44 and to adjust the displacement plunger for level compensation via relay 45.

Relay 45 thus connects the motor lead 50 to the negative battery terminal 52 and the motor lead 51 to the positive battery terminal 53 by closing contact sets 54, 55. This causes the motor to run in the direction raising cylinder 24 vertically, thereby inserting the displacement plunger 25 further into the melt to displace a volume equal to that of the removed charge to maintain the melt level at the desired full datum level.

The amount of plunger displacement can be set for various molds by means of presetting a count on counter 60 which counts motor shaft revolutions by way of pickup sensor 61 and actuates relay 62 at that count. This opens the contact set to remove the motor negative terminal power and stop the motor and thus cylinder 24 travel. Relay 45 contact set 54 supplies the positive terminal power connection and contact set 55 is a relay energization holding contact connected to the negative power terminal 52 for energization after the impulse at sensor terminal 42 expires. This holding connection is also released by the counter relay 62 to restore motor leads 50, 51 to unconnected condition. Thus, for each injection cycle an impulse at 42 will cause an automatic incremental melt level compensation of precisely that amount adjusting for removal of a charge injected to the die cold chamber.

When the cylinder 24 advances to an upper limiting position indicating the molten material in the reservoir pot 18 is low, then feeler 35 encounters the switch set 36 to close it and operate relay 70, which is held energized by contact set 71. Contact set 72 connects the positive power terminal 73 to motor lead 50, a polarity reversing the motor direction to lower cylinder 24 to a restart position. The negative terminal 74 is connected to motor terminal 51 via contact sets 37 and 71 to complete the motor circuit. Thus, feeler 35 will start moving downward with cylinder 24 until contact set 37 is opened at the lower limit position to open the motor circuit and the relay 70 holding circuit. This then provides automatic reset of the system for a new cycle after recharging the melting pot 18 with a new reservoir supply of material. Auxiliary control circuits can be used to adjust the motor to predetermined positions, for fusing and protection, etc., as desired.

It is therefore evident from this invention that the state of the art is improved by introduction of a new mode of operation of an injection mold for die cast machines and for a simplified level adjustment mode for maintaining a precise level of the molten materials thereby affording a more precise and accurate metering system for injection of charges into a cold chamber.

Having therefore improved the state of the art, those features are claimed which are believed representative of the nature and spirit of the invention.

INDUSTRIAL APPLICATION

Precise and automatic ladelling of a charge of molten material from a reservoir melting pot into the cold chamber of a die-casting mold is afforded without waste or voids by means of an automatic melt level compensating system that maintains an optimum level of material in the melting pot. Thus, the same precise volume charge can be delivered for all charges processed over the storage range of the melting pot.

I claim:

1. In a mold charge injector for delivering of a measured charge of molten material into a mold chamber by controlled movement of a displacement plunger into a melting pot containing the molten material, the improvement for keeping molten material in the melting pot at a precisely determined datum level as successive charges are delivered from the pot, comprising in combination, a displacement plunger operational in the melting pot to displace molten material for a plurality of measured charges during supply of a successive series of charges from the pot by movement thereinto and to produce changes of the level of molten materials in the pot as it moves thereinto, first charge delivery movement means for inserting the displacement plunger a controlled distance into the melting pot to measure out a charge of material and inject it into the mold chamber, and second automatic vernier datum level control supplemental movement means comprising a screw adjustment mechanism for adjustably relatively changing the displacement position of said plunger into the molten material in said melting pot and an automatic control circuit making adjustments thereto in increments over a plurality of injection strokes of said first movement means as successive charges are removed from the melting pot to displace the level of the molten material just enough to provide a substantially constant starting datum level of molten materials for the plunger to begin a following injection stroke in response to the first movement means.

2. The improvement defined in claim 1 including means responsive to the amount of molten material in the melting pot to initiate a refilling cycle, and reset means for readjusting the automatic vernier control means for operation at a molten material level after the pot is refilled.

3. The improvement defined in claim 1 including a reciprocating mechanism delivering the charge during a reciprocating cycle powered by a hydraulic piston and coupled to move said plunger, and the automatic vernier control means physically displaces the hydraulic piston to move it further into the molten materials in said increments compensating for changes in material datum level produced by each charge of materials delivered from the melting pot.

4. The improvement defined in claim 3 wherein the automatic vernier control means comprises an electric motor, said screw adjustment mechanism driven by the motor and a control circuit operating the motor to move the piston said increments for each injection of a charge from the pot by means of said plunger.

5. The improvement as defined in claim 1 wherein the melting pot consists of a pump chamber in which the displacement plunger reciprocates.

* * * * *